US006799614B1

(12) United States Patent
Smith et al.

(10) Patent No.: US 6,799,614 B1
(45) Date of Patent: Oct. 5, 2004

(54) DISPENSING TOOL ASSEMBLY FOR A FLUID FILL TUBE

(75) Inventors: Matthew A. Smith, Dayton, OH (US); Randy S. Robinson, Bradford, OH (US)

(73) Assignee: Production Control Units, Inc., Dayton, OH (US)

( * ) Notice: Subject to any disclaimer, the term of this patent is extended or adjusted under 35 U.S.C. 154(b) by 0 days.

(21) Appl. No.: 10/724,297

(22) Filed: Nov. 28, 2003

(51) Int. Cl.[7] ..... B65B 1/04; B65B 3/00; B67C 3/00

(52) U.S. Cl. ..... 141/312; 141/46; 141/54; 141/287; 141/382; 141/383; 141/389; 141/390; 141/392

(58) Field of Search ..... 141/18, 37, 46, 141/54, 285, 287, 312, 382, 383, 387–392

(56) References Cited

U.S. PATENT DOCUMENTS 5,560,407 A 10/1996 Swinford
6,029,720 A * 2/2000 Swinford ..... 141/385
6,257,285 B1 7/2001 Robinson et al.
6,298,886 B1 10/2001 Robinson et al.

* cited by examiner

*Primary Examiner*—Timothy L. Maust
(74) *Attorney, Agent, or Firm*—Jacox, Meckstroth & Jenkins

(57) ABSTRACT

Fuel is dispensed into a fuel tank fill tube by a hand-held tool assembly having a body with an outlet tube connected to a fuel supply passage through an air actuated control valve. Spring biased arcuate jaws surround the outlet tube and expand outwardly into engagement with an inner surface of the fill tube by an air actuated annular clamping piston surrounding the outlet tube. An air actuated annular sealing piston surrounds the clamping piston and is effective to seal the outer end of the fill tube after the fill tube is clamped. The position of the fill tube is sensed by a pin which actuates a proximity switch, and a handle and fluid line connectors projecting from the body at right angles to the outlet tube. Thumb operated control switches are located adjacent the handle.

20 Claims, 4 Drawing Sheets

2
128
138
128
137
125
14
110
10
111
44
12
18
16
2
68
65

3
126
125
10
14
33
111
135
107
51
110
94
118
16
154
65
68
23
3

DISPENSING TOOL ASSEMBLY FOR A FLUID FILL TUBE

BACKGROUND OF THE INVENTION

This invention relates to a fluid dispensing tools or tool assembly of the general type disclosed in U.S. Pat. No. 5,560,407, No. 6,257,285 and No. 6,298,886 which issued to the Assignee of the present invention. Such tools are commonly used on a motor vehicle assembly line for evacuating and charging an air conditioning system and a coolant system for the vehicle and are connected by flexible lines to a control unit which provides for evacuating the system to a predetermined evacuation pressure, tests the system for leaks and then charges the system with a selectable predetermined volume of liquid such as liquid refrigerant or coolant.

SUMMARY OF THE INVENTION

The present invention is directed to an improved fluid dispensing tool assembly of the general type disclosed in the above identified patents and which is ideally suited for testing and charging or filling a fuel storage tank in a motor vehicle on the vehicle assembly line. Such a fuel storage tank commonly includes a fill tube which extends upwardly from the tank to a fill tube neck portion which has internal threads for receiving a removable fuel sealing cap. The fluid dispensing tool assembly of the present invention releasably and positively grips the inner surface of the fill tube neck portion and then forms a fluid-tight seal with an outer end flange on the neck portion. The tool assembly also provides for conveniently holding and handling the tool assembly in an ergonomic manner and for operating the controls of the tool assembly. The tool assembly further provides for substantial durability and for convenient servicing.

In accordance with one embodiment of the invention, the above features are provided by a tool assembly including a body defining a fluid or fuel supply passage with an air actuated control valve and extending from an inlet to an outlet tube having an axis perpendicular to the axis of the inlet. An annular clamping piston surrounds the outlet tube and is effective to expand a set of arcuate clamping jaws outwardly into engagement with the neck portion of the fill tube. An annular sealing piston surrounds the clamping piston and carries resilient sealing rings for forming a fluid-tight seal with an outer end portion of the fill tube. The main fluid control valve and the annular pistons are each actuated by pressurized air supplied through passages within the body. An axially movable pin is supported by the body outboard of the sealing piston for detecting the presence of the fill tube flange and for actuating a proximity switch after the outlet tube has been properly positioned on the fill tube. The fluid supply and air actuating lines connect to the tool assembly by fittings having corresponding axes perpendicular to the axis of the outlet tube, and the body is supported by an upper horizontally extending handle projecting from a body portion having thumb actuated switches to control the cycle of operation of the tool assembly.

DESCRIPTION OF THE PREFERRED EMBODIMENT

Figure 1:
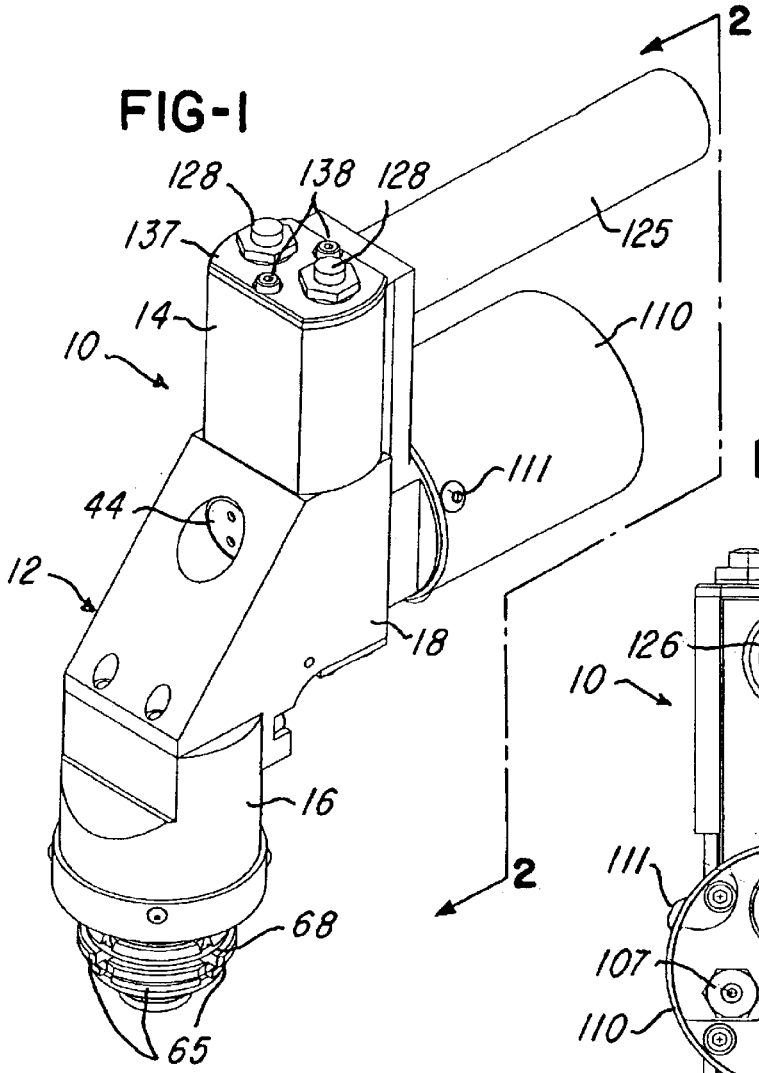
FIG. 1 is a perspective view of a fluid dispensing tool assembly constructed in accordance with the invention.
Figure 2:
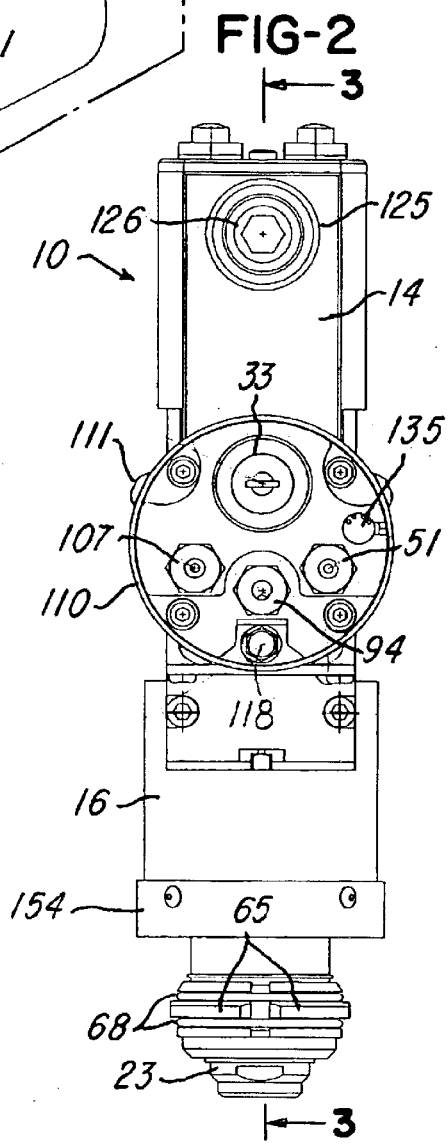
FIG. 2 is an elevational view taken generally on the line 2—2 of FIG. 1.

FIGS. 1 and 2 show a fluid dispensing tool assembly 10 constructed in accordance with the invention and which is ideally suited for partially or completely filling a fuel storage tank within a motor vehicle at the end of the vehicle assembly line. However, the tool assembly 10 may also be used for pressure testing a fuel storage tank or for filling other liquids into a fill tube. The tool assembly 10 is controlled by a remotely located control system or unit (not shown) which is connected to the tool assembly 10 by a flexible fuel supply line and flexible fluid or air actuation lines, as will be explained later. The tool assembly 10 includes a body 12 which is preferably machined from aluminum and includes an upper support section 14 and a lower outlet section 16 rigidly connected by an intermediate section 18. The lower body section 16 has an outlet tube 20 (FIGS. 3–5) having a vertical axis 21 and a lower nozzle portion 23. The outlet tube 20 defines a fluid or fuel supply passage 25 which extends through the body sections 16 and 18 (FIG. 3) to a fuel inlet 27 within a manifold 28 forming part of the body 12.

The fuel inlet 27 is supplied with pressurized fuel through a flexible fuel supply hose or line 31 (FIG. 3) connected to the manifold 28 by a threaded coupling or fitting 33. The fuel supply passage 25 is normally closed by a fill control valve 36 (FIGS. 3 and 5) having a valve stem 38 with an enlarged head portion supporting a resilient O-ring 39 and an opposite end portion secured to an air actuated piston 42 within a cylindrical bore closed by a threaded end plug 44. A compression spring and the pressure of the fuel normally closes the valve 36 (FIG. 3), and the valve is moved to its open position (FIG. 5) in response to pressurized air within passages 47 (FIG. 5) supplied to the tool assembly through a flexible air actuating line or tube 49 connected to the manifold 28 by a quick connect coupler or fitting 51.

Figure 3:
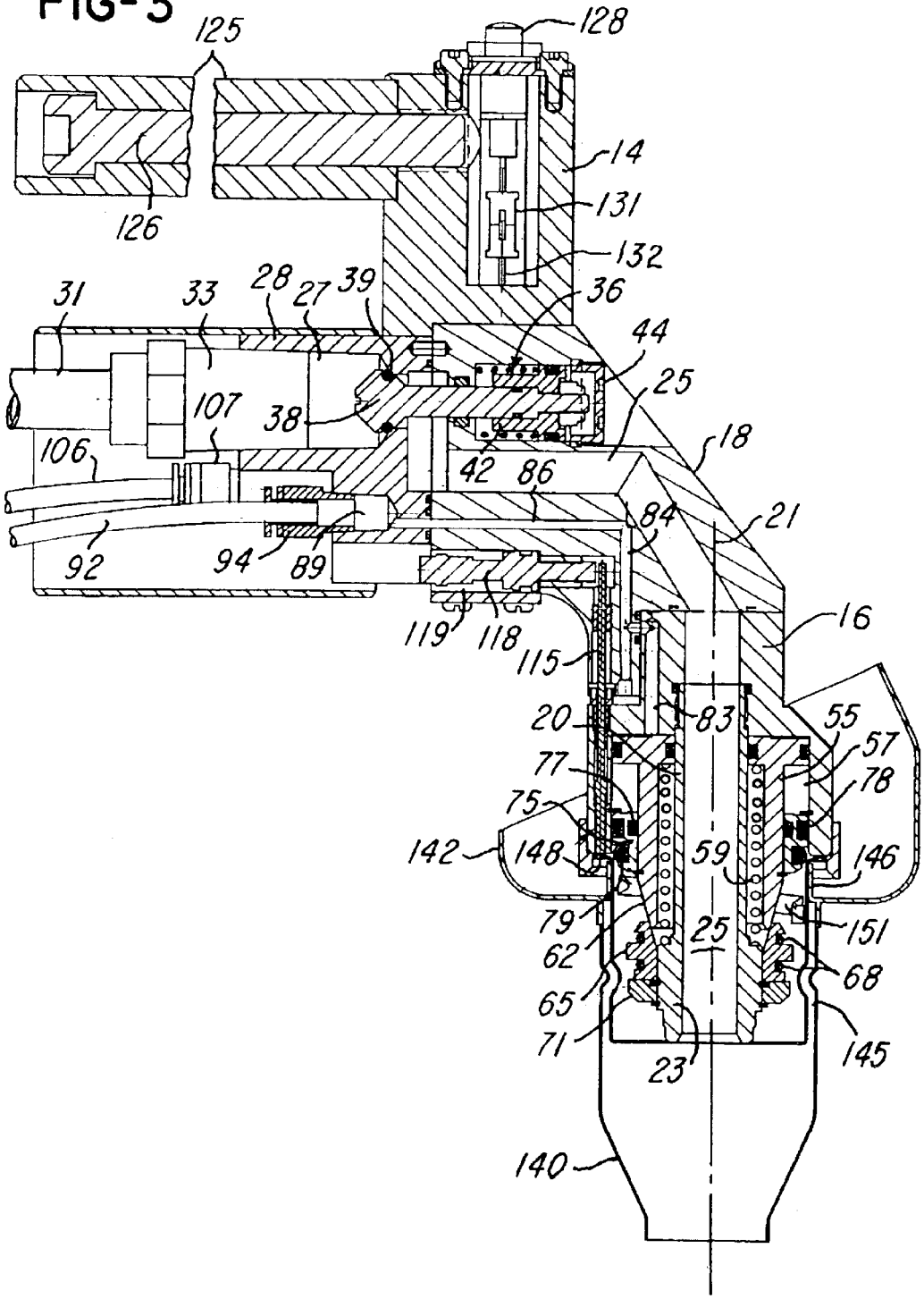
FIG. 3 is a section taken generally on the line 3—3 of FIG. 2 and showing the tool assembly inserted into a fill tube of a fuel storage tank prior to clamping.
Figure 4:
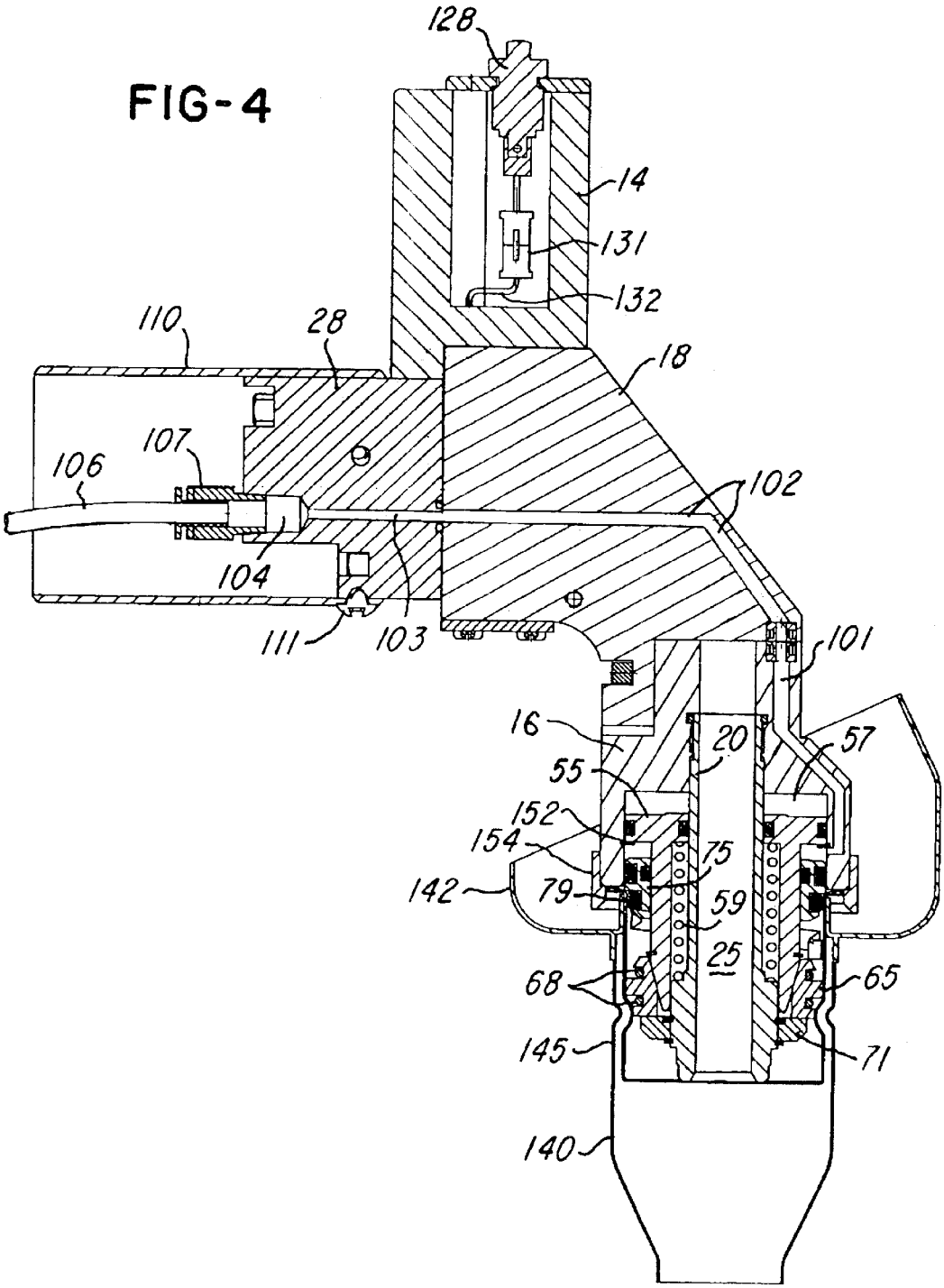
FIG. 4 is a section similar to FIG. 3 and showing the tool assembly clamped to and sealed with the fuel tank fill tube.
Figure 5:
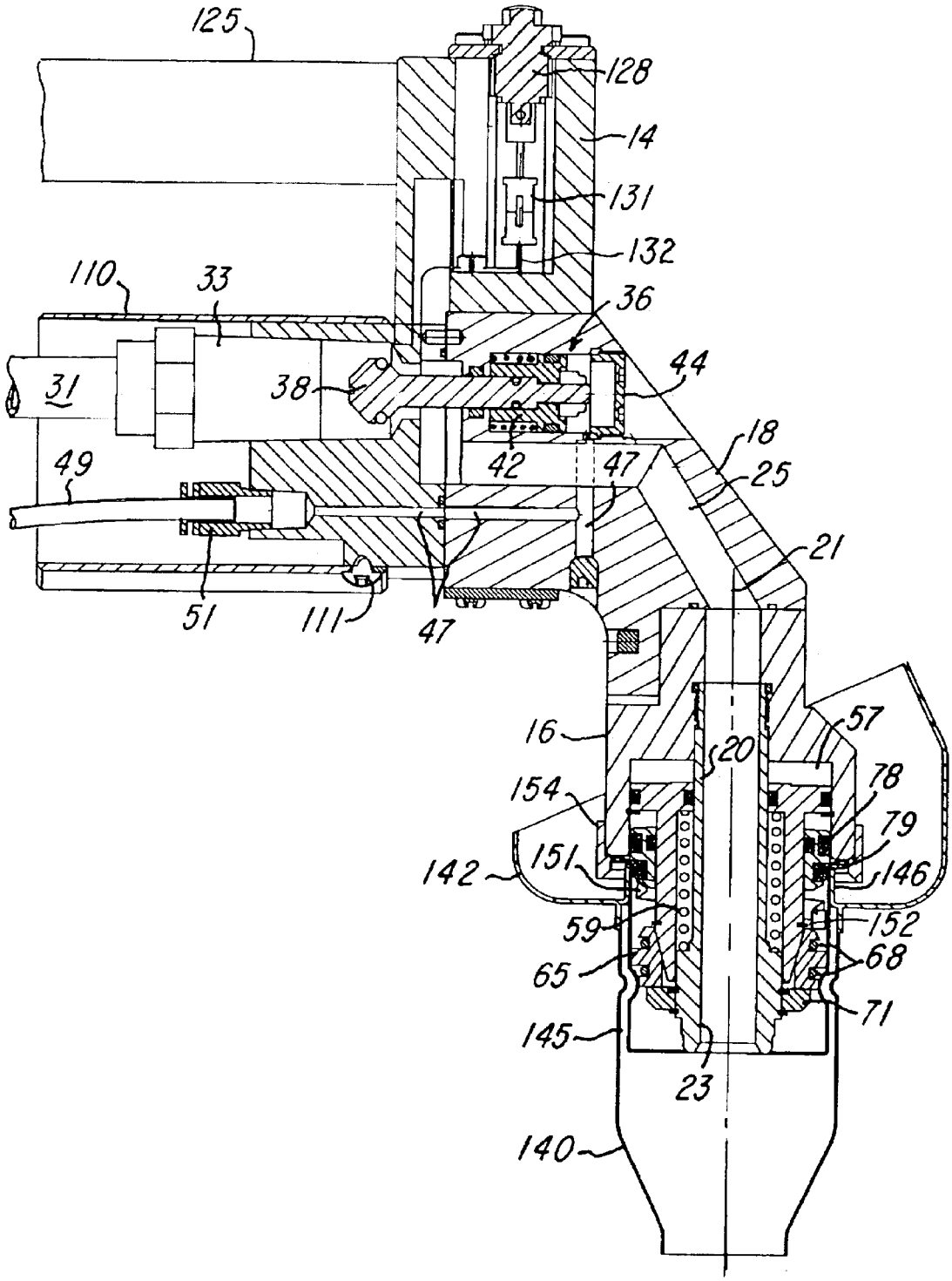
FIG. 5 is a section similar to FIG. 3 and showing the fuel supply passage with an open fill control valve.

Referring to FIGS. 3 & 4, an annular clamping piston 55 surrounds the outlet tube 20 and is moveable axially within a cylindrical chamber 57 between an upper retracted position (FIG. 3) and a downward extended position (FIG. 4). A compression spring 59 extends between a shoulder on the outlet tube 20 and the clamping piston 55 and normally urges the clamping piston to its upper retracted position shown in FIG. 3. The clamping piston 55 has a tapered or frusto-conical lower end surface 62 positioned to engage mating tapered surfaces on a set of four arcuate clamping jaws 65 surrounding the lower nozzle portion 23 of the outlet tube 20. The clamping jaw 65 are preferably molded of a rigid plastics material and are normally held in radially retracted positions (FIG. 3) by a pair of ring-like extension springs 68. An annular support collar 71 is secured to the nozzle portion 23 of the outlet tube 20 by retaining rings to support the clamping jaws 65 for radial movement between retracted positions (FIG. 3) and the radially outwardly clamping positions (FIG. 4).

An annular sealing piston 75 surrounds the clamping piston 55 and is confined within the cylindrical chamber 57 for axial movement between an upper retracted position (FIG. 3) and a lower sealing position (FIG. 4). The sealing piston 75 carries a set of resilient O-rings 77, 78 and 79 to form fluid-tight seals. As shown in FIG. 3, the clamping piston 55 is moved from its normally upper retracted position to its clamping position, for expanding the jaws 65, by pressurized air supplied through a series of air actuating passages 83, 84 and 86 which extend through the body sections 16 and 18 and manifold 28 to an inlet 89. Pressurized air is supplied to the inlet 89 and connected passages through a flexible or air actuating line or tube 92 connected to the inlet 89 by a tube connector or fitting 94.

Referring to FIG. 4, pressurized air is supplied to the chamber 57 above the sealing piston 75 and below the upper end portion of the clamping piston 55 through passages 101, 102 and 103 extending through the body sections and manifold 28 to an inlet 104. Pressurized air is supplied to the inlet 104 through a flexible air actuating line or tube 106 connected to the manifold 28 by a tube coupling or fitting 107. The fittings 33, 51, 94 and 107 are all enclosed and protected by a cylindrical collar 110 which is secured to the manifold 28 by peripherally spaced screws 111.

Referring to FIG. 3, an elongated sensing pin 115 extends through aligned bores within the body sections 16 and 18 and is supported for longitudinal or axial movement outboard of the sealing piston 75 and parallel to the axis 21 of the outlet tube 20. The pin 115 moves between an upper position, (FIG. 3) and a lower projecting position (not shown), and in its upper position, the pin is effective to actuate a proximity switch 118 located within a horizontal bore 119 within the body section 18. Flexible electrical conductors (not shown) connect with the proximity switch 118 (FIG. 2) within the collar 110.

The upper body section 14 (FIG. 3) is secured to the body section 18 by screws (not shown) and receives a tubular handle 125 attached to the body section 14 by a center bolt 126 threaded into the body section 14. The upper body section 14 also supports two electrical control or start and stop switches 128 having electrical conductors connected by quick-connect couplers 131 to conductors 132 which extend through the body sections 14 and 18 to an electrical plug-in connector or socket 135 (FIG. 2) enclosed within the sleeve 110. The switch units 128 are threaded into the body section 14 under a retaining plate 137 attached by a pair of screws 138.

In operation of the tool assembly 10, the lower end portion 23 of the outlet tube 20 and the surrounding clamping jaws 65 are inserted (FIG. 3) into a fill tube 140 connected to a fuel storage tank (not shown) within a motor vehicle, and the upper end portion of the fill tube 140 is connected to a cup-shaped housing 142. The fill tube 140 has an internal tubular neck portion 145 which extends through a cylindrical collar 146 of the housing 142 and has an outwardly projecting upper end flange 148. The neck portion 145 of the fill tube 140 also has integrally formed and inwardly projecting helical threads 151 which are commonly used for securing a conventional threaded fuel cap (not shown) to the fill tube 140.

When the tool assembly 10 is fully inserted into the fill tube 140, a collar 154 surrounds the top flange 148. The sensing pin 115 engages the top end flange 148 on the fill tube and shifts upwardly to actuate the proximity switch 118 and provide a signal that the tool assembly 10 is in proper position with respect to the fill tube 140. When the proximity switch is actuated, the cycle of operation of the tool assembly commences under the control of the remote control unit connected to the tool assembly 10 by the flexible air pressure actuating lines or tubes 49, 92, 106, the electrical conductors, and the flexible fuel supply line or tube 31. When pressurized air is received within the connected passages 83, 84 and 86, the clamping piston 55 moves downwardly from its upper position (FIG. 3) to its extended position (FIG. 4) so that the tapered surface 62 on the clamping piston 55 cams the arcuate jaws 65 radially outwardly to engage the neck portion 145 of the fill tube 140 axially inwardly of the helical threads 151 thereby obtaining a positive grip and connection to the fill tube 140. Pressurized air is then supplied to the connected passages 101, 102 and 103 to move the sealing piston 75 downwardly from its retracted position (FIG. 3) to its sealing position (FIGS. 4 and 5) where the lower resilient sealing ring 79 enters the upper end portion of the fill tube 140, and forms a fluid-tight seal.

After the tool assembly 10 is clamped and sealed to the fill tube 140, pressurized air is supplied to the passages 47 (FIG. 5) to shift the piston 42 of the valve 36 to the left for moving the valve stem 38 to its open position. Pressurized fuel supplied through the line 31 then flows through the passages 25 and into the fill tube 140 through the outlet tube 20. After a predetermined volume of fuel has been supplied to the storage tank through the fill tube 140, the fuel control valve 36 closes, and pressurized air to the upper ends of the clamping piston 55 and sealing piston 75 is released so that the piston 55 returns or shifts upwardly by the spring 59 to its released position (FIG. 3) for releasing the clamping jaws 65 which return to their retracted or released positions by the surrounding springs 68. When the clamping piston 55 shifts upwardly, a retaining ring 152 on the piston 55 carries the sealing piston 75 upwardly to its upper position (FIG. 3) out of sealing engagement with the fill tube neck portion 145. The clamping piston 55 and sealing piston 75 move axially only a few millimeters.

From the drawings and the above description, it is apparent that a fluid dispensing tool assembly constructed in accordance with the invention provides desirable features and advantages, especially for filling an automotive vehicle fuel tank on an assembly line. For example, the tool assembly 10 forms a positive coupling or mechanical clamp with the inner surface of the fuel tank fill tube and inwardly of the integrally formed threads. The sealing piston 75 also forms a fluid-tight seal with the inner cylindrical surface of the fill tube, and the sensing pin 115 detects the presence of the upper end flange 148 on the fill tube. In addition, the tool assembly may be conveniently serviced, for example, by replacing the O-ring seal 79 or the arcuate clamping jaws 65. The general L-shaped configuration of the tool assembly 10 and the position of the handle 125 provides for conveniently supporting and maneuvering the tool assembly while the collar 110 provides protection for all of the connections or couplings of the fluid and electrical lines. The location of the control push buttons 128 further provides for conveniently actuating and controlling the tool assembly.

While the form of tool assembly, herein described constitutes a preferred embodiment of the invention, it is to be understood that the invention is not limited to this precise form of tool assembly, and that changes may be made therein without departing from the scope and spirit of the invention as defined in the appended claims.

What is claimed is:

1. A fluid dispensing tool assembly adapted for connecting a fuel supply line to a fill tube extending from a fuel tank, said assembly comprising a body defining a fluid supply passage having a fluid actuated control valve and extending to an outlet tube having an axis, a set of arcuate clamping jaws surrounding said outlet tube, an annular fluid actuated clamping piston surrounding said outlet tube and effective to expand said clamping jaws outwardly into engagement with an inner surface of said fill tube in response to axial movement of said clamping piston, an annular sealing piston surrounding said clamping piston and effective to move a sealing ring into substantially fluid-tight sealing engagement with said fill tube in response to axial movement of said sealing piston after said fill tube is clamped, fluid actuating passages within said body and extending to said control valve, said clamping piston and said sealing piston, and connectors adapted to connect said fluid actuating passages to corresponding flexible fluid actuating lines.

2. A tool assembly as defined in claim 1 and including a sensor on said body for detecting the position of the fill tube relative to said body.

3. A tool assembly as defined in claim 1 wherein all of said passages have corresponding portions with axes disposed generally perpendicular to said axis of said outlet tube.

4. A tool assembly as defined in claim 1 and including a protective collar supported by said body and extending around said connectors.

5. A tool assembly as defined in claim 1 and including a handle connected to said body and having an axis extending generally perpendicular to said axis of said outlet tube.

6. A tool assembly as defined in claim 5 and including a push button control switch disposed adjacent said handle for controlling the operation of said tool assembly.

7. A tool assembly as defined in claim 1 wherein said annular sealing piston carries a removable resilient sealing ring for engaging said fill tube.

8. A tool assembly as defined in claim 1 wherein each of said arcuate clamping jaws has a tapered upper inner surface, and said clamping piston has a tapered lower outer surface positioned to engage said inner surfaces of said clamping jaws for camming said jaws outwardly.

9. A tool assembly as defined in claim 1 and including a fill tube sensing pin supported by said body for axial movement radially outwardly of said sealing piston and substantially parallel to said axis of said outlet tube, and a proximity switch supported by said body for detecting the position of said sensing pin.

10. A fluid dispensing tool assembly adapted for connecting a fuel supply line to a fill tube extending from a fuel tank, said assembly comprising a body defining a fluid supply passage having a fluid actuated control valve and extending to an outlet tube having an axis, a set of arcuate clamping jaws surrounding said outlet tube, an annular fluid actuated clamping piston surrounding said outlet tube and effective to expand said clamping jaws outwardly into engagement with an inner surface of said fill tube in response to axial movement of said clamping piston, an annular sealing piston surrounding said clamping piston and effective to move a sealing ring into substantially fluid-tight sealing engagement with said fill tube in response to axial movement of said sealing piston after said fill tube is clamped, fluid actuating passages within said body and extending to said control valve, said clamping piston and said sealing piston, all of said passages having corresponding portions with axes disposed generally perpendicular to said axis of said outlet tube, connectors adapted to connect said fluid actuating passages to corresponding flexible fluid actuating lines, and an electrical sensor on said body for detecting the position of the fill tube relative to said body.

11. A tool assembly as defined in claim 10 and including a handle connected to said body above said connectors and having an axis extending generally perpendicular to said axis of said outlet tube.

12. A tool assembly as defined in claim 11 and including a push button control switch disposed adjacent said handle for controlling the operation of said tool assembly.

13. A tool assembly as defined in claim 10 wherein said annular sealing piston carries a removable resilient sealing ring for engaging said fill tube.

14. A tool assembly as defined in claim 10 wherein each of said arcuate clamping jaws has a tapered upper inner surface, and said clamping piston has a tapered lower outer surface positioned to engage said inner surfaces of said clamping jaws for camming said jaws outwardly.

15. A tool assembly as defined in claim 10 and including a protective collar supported by said body and extending around said connectors.

16. A tool assembly as defined in claim 10 and including a fill tube sensing pin supported by said body for axial movement radially outwardly of said sealing piston and substantially parallel to said axis of said outlet tube, and said sensor comprises a proximity switch supported by said body for detecting the position of said sensing pin.

17. A fluid dispensing tool assembly adapted for connecting a fuel supply line to a fill tube extending from a fuel tank, said assembly comprising a body defining a fluid supply passage having a fluid actuated control valve and extending to an outlet tube having an axis, a set of arcuate clamping jaws surrounding said outlet tube, an annular fluid actuated clamping piston surrounding said outlet tube and effective to expand said clamping jaws outwardly into engagement with an inner surface of said fill tube in response to axial movement of said clamping piston, fluid actuating passages within said body and extending to said control valve and said clamping piston, and connectors adapted to connect said fluid actuating passages to corresponding flexible fluid actuating lines.

18. A tool assembly as defined in claim 17 wherein all of said passages have corresponding portions with axes disposed generally perpendicular to said axis of said outlet tube.

19. A tool assembly as defined in claim 17 wherein each of said arcuate clamping jaws has a tapered upper inner surface, and said clamping piston has a tapered lower outer surface positioned to engage said inner surfaces of said clamping jaws for camming said jaws outwardly.

20. A tool assembly as defined in claim 17 and including a fill tube sensing pin supported by said body for axial movement radially outwardly of said clamping piston and substantially parallel to said axis of said outlet tube, and said sensor comprises a proximity switch supported by said body for detecting the position of said sensing pin.

* * * * *